United States Patent [19]

Braun et al.

[11] Patent Number: 4,549,804

[45] Date of Patent: Oct. 29, 1985

[54] HIGH SPEED DUPLICATOR WITH SORTER/STAPLING APPARATUS AND COPY SET SUPPORTING SYSTEM

[75] Inventors: Oskar J. Braun, Williamson; Lawrence C. Hubler, Fairport; Jeffrey L. Sisson, Farmington, all of N.Y.

[73] Assignee: Xerox Corporation, Stamford, Conn.

[21] Appl. No.: 566,752

[22] Filed: Dec. 21, 1983

[51] Int. Cl.[4] ..... G03G 15/00

[52] U.S. Cl. ..... 355/14 SH; 355/3 SH; 270/53

[58] Field of Search ..... 355/3 R, 14 R, 3 SH, 355/14 SH; 270/53, 58; 414/43, 50, 52

[56] References Cited

U.S. PATENT DOCUMENTS

| | | | |
|---|---|---|---|
| 4,029,309 | 6/1977 | Lynch et al. | 270/53 |
| 4,083,550 | 4/1978 | Pal | 270/53 |
| 4,248,525 | 2/1981 | Sterrett | 355/14 SH |
| 4,358,197 | 11/1982 | Kubucka et al. | 355/14 R |
| 4,361,393 | 11/1982 | Noto | 355/3 SH |
| 4,376,529 | 3/1983 | George et al. | 355/14 SH X |
| 4,385,827 | 5/1983 | Naramore | 355/14 SH |
| 4,424,963 | 1/1984 | Bartholet et al. | 355/14 SH X |

*Primary Examiner*—A. T. Grimley
*Assistant Examiner*—J. Pendegrass
*Attorney, Agent, or Firm*—Bernard A. Chiama

[57] ABSTRACT

A copier/finishing system is disclosed as having one or more copy sheet compiling bins whereat copy sheets are collated into copy sets preparatory to a binding operation. In order to support copy sets being moved from one or more bins to a binding station to be stitched or stapled, there is disclosed a copy set support apparatus which supports each copy set being so moved and which is quickly withdrawn to permit the bound copy set to fall by gravity into a set collecting tray.

6 Claims, 4 Drawing Figures

HIGH SPEED DUPLICATOR WITH SORTER/STAPLING APPARATUS AND COPY SET SUPPORTING SYSTEM

This invention relates to a reproduction system, or copying machine, having an improved finishing station for use in such system.

With the advent of higher speed and more sophisticated copy producing machines, printing presses, and the like, considerations as to how the mass of copies generated can best and most effectively be handled has assumed increasing importance. One way has been to provide a copying system with an input device in the form of a recirculating document handling apparatus. In this system, a document sheet is removed from a collated set of document sheets, placed on an exposure platen for exposure at the rate of one exposure for each document sheet, and returned to the top of the set in the document handling apparatus until the set of document sheets has been completely circulated through the apparatus, and a copy set has been produced. The set of document sheets is then recycled for the reproduction of a second copy set, and so on. After each copy set is produced and collected at a collection station, a finishing device such as a stitcher or stapler is activated to bind the set. These systems are of the pre-collation type wherein the document sheets are pre-collated in the document handing apparatus prior to commencement of a reproduction run. The output for the reproduction machine will likewise be pre-collated in sets corresponding to the sequenced numbered document set in the document handling apparatus. The copy sheets are collected in collated sets as they are sequentially produced so that binding may be effected without the interaction of additional devices. Such systems are described in U.S. Pat. No. 4,134,672.

Another type of copying arrangement known as a post-collation system utilizes document handling wherein a predetermined number of light images are produced for each document sheet, say for example, of page one of a multi-page document, before a successive document sheet, perhaps page two of the document is likewise imaged. This sequencing in turn may be repeated many more times if a very large number of copy sets are to be reproduced. As the copy sheets are being produced in accordance with the above imaging procedure, an array of collecting bins or sorter is positioned and vertically moved in either direction to receive the copy sheet output for collating the copy sheets into collated sets, if the system has been programmed for the sets mode of operation or into stacks if in the stacks mode of operation. The bin array or sorter in effect serves as a buffer in the production of finished copy sets when in the sets mode of operation. As these sets are being produced, a finishing device such as a stitcher or stapler is positioned and activated to apply a staple to each set as they are completed. A copying arrangement of this type is disclosed in U.S. Pat. No. 4,444,491 for which the present invention is particularly adapted for incorporation, and therefore the disclosure in this patent is herein incorporated by reference.

Regardless of whether the copying system is of the pre-collation type or of the post-collation type, the movement of copy sets to the staplers has necessitated the need of supporting the copy sets just prior to actual stapling. As copy sets are unloaded from one or more compiling trays and transported to one or more stapling devices, especially at very high speeds, they are transported across open spaces above collecting stations such as a collection elevator whereat the copy sets are deposited by gravity immediately after stapling.

It is therefore the object of the present invention to utilize a copy set supporting device which will insure adequate support of the copy set as the same is moved to a stapling position and be adapted for timely application for support and removal therefrom so as not to impede production.

The present invention is incorporated with a stapling apparatus for binding copy sheets received in succession at a sheet collecting device, or sorter, having a series of individual bins each with an inlet for receiving individual sheets at a sheet receiving station, set transport means for removing each set of collected sheets from the bins; a pair of stapler devices for binding each set after removal from the sorter; and controls for the above.

Other objects and advantages will be apparent from the ensuing description and drawings in which.

Figure 1:
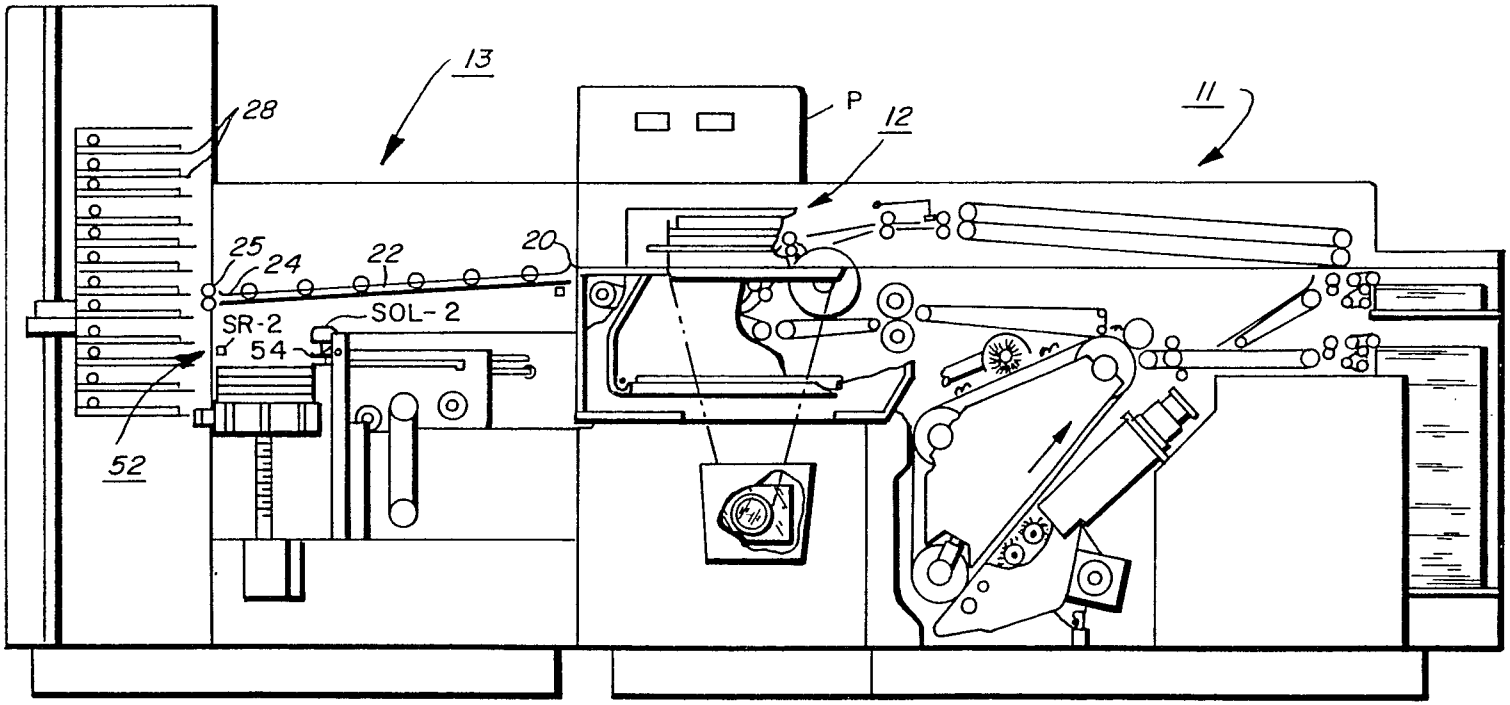
FIG. 1 is a schematic illustration of a configuration of an electrostatographic printing/stapling system employing the present invention.

For a general understanding of a reproduction machine with which the present invention may be incorporated, reference is made to FIG. 1 wherein components of a typical electrostatic printing system or copier are illustrated. The printing system is preferably of the xerographic type as one including a xerographic processor 11, and a document handling apparatus 12. Preferably, the processor 11 is the same as the processor in the commercial embodiment of the Xerox duplicators, models 9400® and 9500® which utilize flash, full frame exposure, for very high speed production. Similarly, the document handling apparatus 12 is the same as those used in the same machines. It will be understood that most any other type of xerographic processor and multiple exposure document handling apparatus may be utilized. Copy sheets are processed in the processor 11 in the conventional xerographic manner as reproductions of document sheets placed in the apparatus 12 and circulated to an exposure station for the copier. A resultant stream of copy sheets exit the processor, and for the particular duplicators identified herein, the stream comprises groups of identical copy sheets awaiting to be collated. Operating in conjunction with the processor 11 and apparatus 12 is a finishing station 13 and thereby forms the reproduction system shown in FIG. 1.

The system comprising the processor 11 and the document handling apparatus 12 is under control of a programmer P which permits an operator various options: to turn the entire system ON or OFF; to program the reproduction system for a desired number of reproductions to be made of each original document sheet or set; to select whether simplex or duplex copies are to be made; to select a desired output arrangement, that is, sets mode or stacks mode, stapled or unstapled; to select one of a plurality of paper trays; to condition the machine for the type of document, that is, whether one sided or two sided, to select a copy size reduction mode, and other desirable functions. The programmer P also includes a controller which provides all operational timing and synchronization between the processor 11 and all of its xerographic processing functions, and system control functions, the automatic events to be described hereinafter. The controller may include any suitable microprocessor having a CPU and the appropriate machine clock, but prefereably the processor is one similar to the Intel 8080 microprocessor manufactured by the Intel Corporation, Santa Clara, Calif., and having sufficient ROM's and RAM's for all the necessary functions in the reproduction system.

Further details of the processing devices and stations in the printer system or processor are not necessary to understand the principles of the present invention. However, a detailed description of these processing stations and components along with the other structures of the machine printer are disclosed in U.S. Pat. No. 4,054,380 which is commonly assigned with the present invention and which is incorporated by reference herein. For the complete apparatus and description thereof to which the present invention may be applied is illustrated and described in U.S. Pat. No. 4,444,491 commonly assigned, and which is incorporated by reference herein.

Copy sheets exiting the processor 11 are transported through an exit slot 20. The sheets are directed to the finishing station 13 which comprises a sorting mechanism, a stapler apparatus, and an output elevator/conveyor system. After leaving the processor 11, as shown in FIG. 1, each sheet is positioned upon a transport 22 to be further conveyed generally along the same horizontal plane as its previous path to a fixed receiving point or station 24.

At the exit slot 20, a sheet contacting switch S-1 is positioned to be actuated as each sheet enters the transport 22 of the finishing station 13. The circuit for this switch is connected to the logic in the programmer P and serves to reset the machine clock for the finishing function so that zero time for the sheet commences when the sheet is at the reference point 24.

At the receiving station 24, there is positioned a pair of contacting transport rollers 25 which receive each copy sheet within the nip for directing a sheet into a bin of an array of collecting bins, or sorter generally indicated by the reference numeral 28. In the illustrated embodiment, the array 28 includes twelve horizontally disposed bins 30 arranged in a vertical column, the number of which corresponds to the predetermined number of exposures made of each document sheet while it is on the exposure platen for the copy processor 11.

The bin array 28 is mounted for bi-directional vertical indexing movement within a supporting fixed machine frame 32 and is positioned in its normal standby position with the lowermost bin opposite the nip of the rollers 25 at the fixed station 24. Details as to structural and operating sequences is described in the above referenced to U.S. Pat. No. 4,444,491.

As described hereinafter in the above-referred to patent, a set stapling system in the form of a dual stapler apparatus is arranged immediately below the bin receiving point 24. This apparatus includes means to remove completed sets of collated copy sheets from every other bin to effect single or dual stapling along an edge of the set if so programmed or not stapling at all, and to position the stapled or unstapled sets on an elevator mechanism. In order to permit complete removal of the sets from all of the bins 30 in the array 28, the array must move twice relative to the point of set unloading.

The bin array 28 is driven vertically in either direction in indexing fashion by a screw 34 connected to the shaft of a servo motor mounted on the base of the frame 32. Rotation of the screw 34 (which is fixed against axial movement) in either direction will impart corresponding up or down movement of the ball the array 28.

Figure 2:
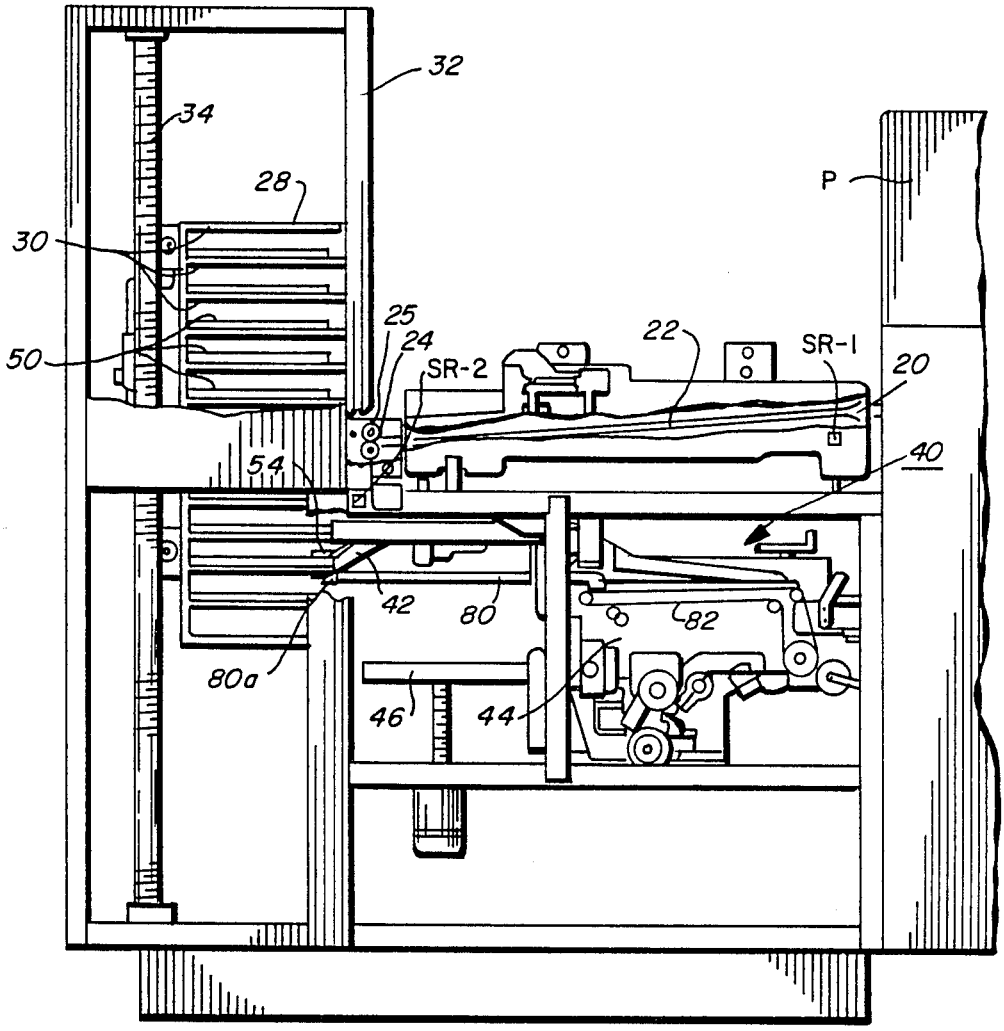
FIG. 2 is an elevational view of the stapling station utilized in the system of FIG. 1.
Figure 3:
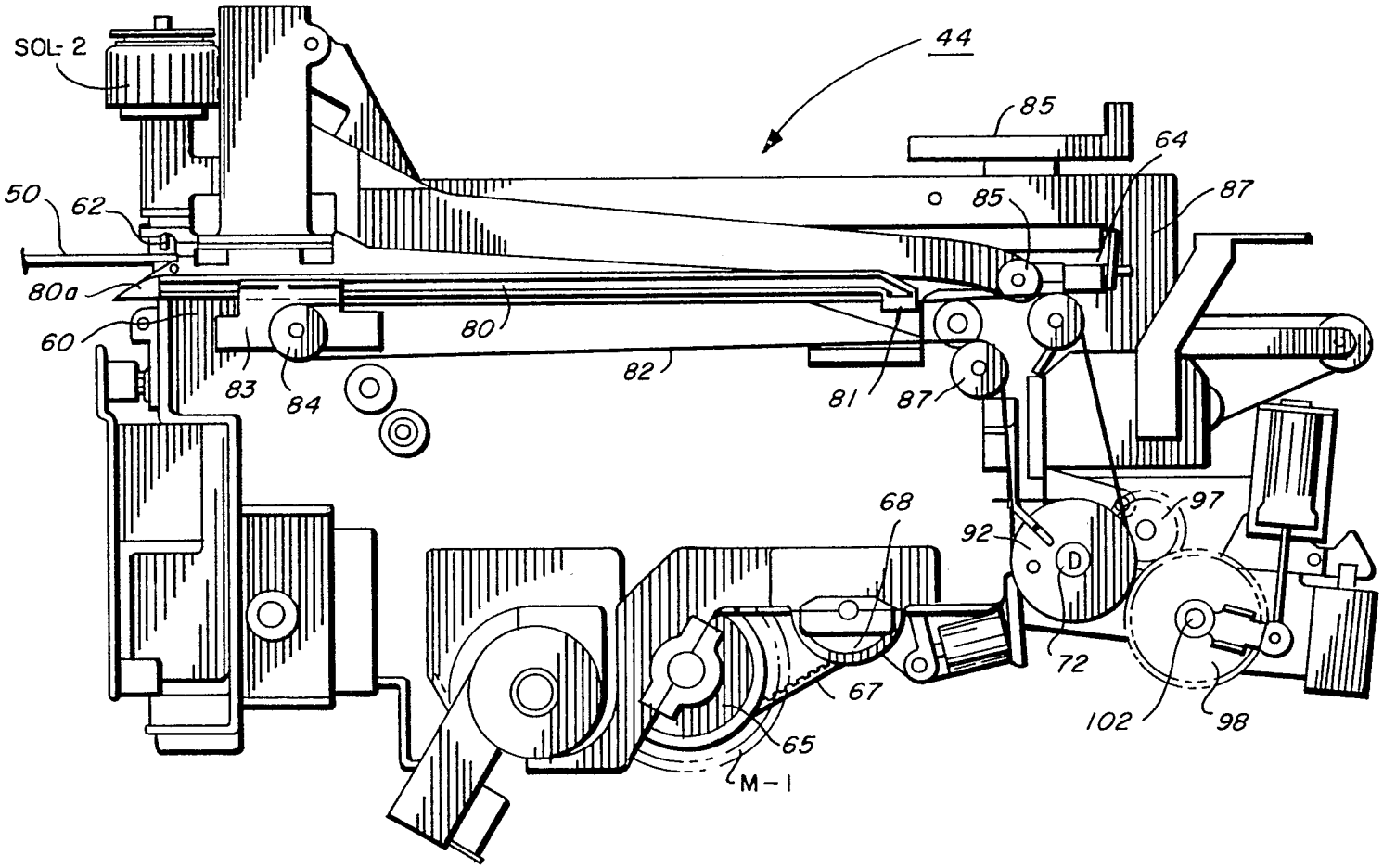
FIG. 3 is an elevational view of one of the stapling devices in the stapling station of FIG. 2.

After copy sheets, simplex or duplex, have been produced in the processor 11, transported by the transport 22 and collected in the bin array 28 while the system is in either the sets mode or the stacks mode, the collected sets are now in condition to be further processed by a finishing apparatus generally indicated by the reference number 40. The finishing apparatus comprises five subassemblies each of which is programmed to operate in timed sequence with each other, with the system logic and programmer P, to be timed relative to the number of sets and copy sheets per set which were previously pre-programmed, and with the document sheet actuation of the apparatus 12. As shown in FIGS. 2 and 3, the finishing apparatus comprises a set transport 42, individually operable, dual stapler devices 44, and a set kicker (not shown). In conjunction with the finishing apparatus 40, the finishing station 13 also includes an elevator 46.

The set transport 42 is utilized to unload automatically copy sets 50 or stacks of copy sheets from the bins at an unload station 52 two copy cycle pitches or bins below the sorter bin load station at 24. As shown in FIG. 2, the set transport 42 includes a clamp 54 which is adapted to grip an edge of a set or stack and convey the same from the bin array to the stapler apparatus 40 for a stapling operation, if that has been pre-programmed, or directly to the elevator 46 if programmed for the non-stapled mode.

The set 42 transport also includes a reversible servo motor (not shown) to effect reciprocable movement of the clamp 54 to the sorter to a set gripping position, in the opposite direction to a set stapling position, and still further in that direction, to retract the clamp all in cyclic actuation. In moving toward the sorter 28, the clamp 54 is sensed by a sensor SR-2 mounted on the frame for the sorter to zero reference the positioning of the set transport as a timing monitor of subsequent timed events in the finishing function. The clamping and unclamping action of the clamp 54 is provided by a solenoid valve (not shown) in a suitable pneumatic power device which may be operatively connected to the clamp.

The stapler apparatus 40 as shown in FIG. 2 provides a stapling function either with a single staple or with two staples, both being adapted to be applied at various positions along a long edge of a set or stack of copy sheets. Stapling is achieved by way of the two identical stapling devices 44, as shown in FIG. 3, each of which provides the function of set clamping, staple driving, and staple clinching. Preferably, the stapling devices utilize two commercial type stapler heads 60, such as the Bostitch staple head indicated as the 64-E manufactured by the Bostitch Division of Textron Corporation of Providence, R.I. Since the stapler mechanisms, drives therefor, and related structure are identical, only one will be described.

As shown in FIG. 3, the stapler device 44 comprises the stapler head 60 having a clamping position 62 to which an edge of each copy set is transported by the set transport 42. At the position 62, the stapler head 60 is adapted, upon energization of a solenoid SOL-2 to effect clinching of the legs of a staple after the same has been separated from a stick of staples within a staple magazine 64 in the lead 60, driven by a driver (not shown) in the head 60 through the sheets of the copy set in the conventional manner. With one or more staples being driven through the sheets of the copy sets, clinching of the staple legs is then accomplished by the energization of the solenoid SOL-2, as aforesaid.

Stapling in the stapling device 44 is accomplished by a drive system including a drive pulley 65 connected to the shaft of a drive motor M-1 for driving both devices 44. Further details of this drive system and staple drive is fully disclosed in the above referred to U.S. Pat. No. 4,444,491 which is hereby incorporated by reference and therefore are not necessary for understanding the present invention. In operation of the stapling devices 44, the motor M-1 is in continuous operation and electromagnetic clutches within the stapling drive system are energized at approximate time relationship to drivingly convert the motor M-1 to the various gears and pulley to effect clamping of a copy set within the clamping station 62, driving of one or more staples through the edge of the copy set being bound, and clinching of the staple legs by energization of the solenoid SOL-2, as aforesaid.

Figure 4:
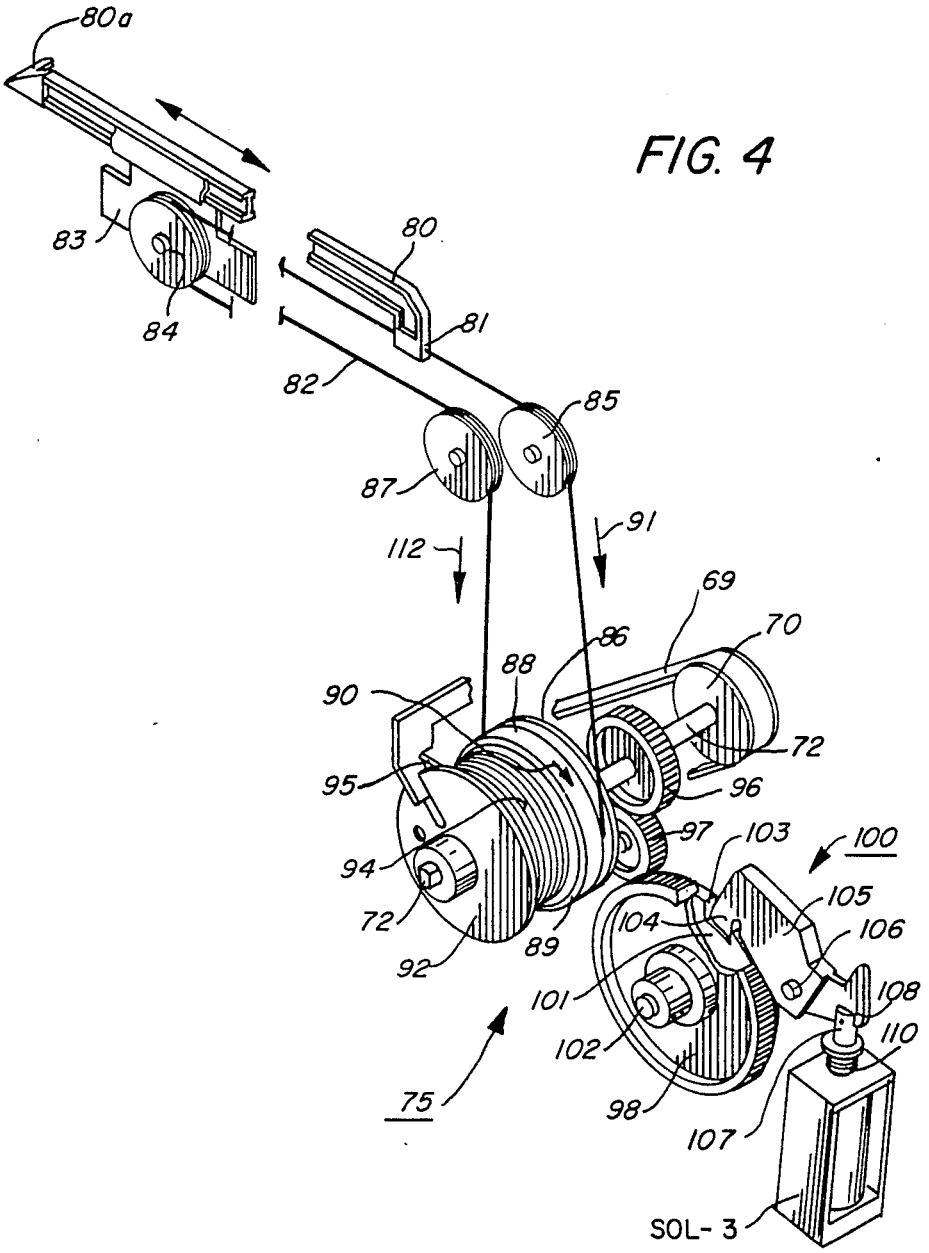
FIG. 4 is an isometric view of the drive system for the copy set support apparatus of the present invention.

The present invention also derives its drive power from the motor M-1 by a drive train of timing belts and gears as will be presently described. As shown in FIG. 3, the motor M-1 drives a timing belt 67 to a gear 68, secured to a shaft 72 of a drive mechanism generally indicated by the reference numeral 75 (see FIG. 4). The drive mechanism is utilized in conjunction with a copy set transport system arranged to move a support member at high speed as the set transport is activated to its copy set clamping position as shown in FIG. 2 and to retract the support member after the copy set has been stapled so that the copy set may be dropped by gravity into the copy set collecting elevator 46.

The copy set support system includes a copy set support member in the form of a rod 80 associated with each of the stapler devices 44. Since the copy set support rod and drive mechanism therefore are duplicate for each of the devices 44, only one will be described herein in detail. Each of the rods 80 are arranged for reciprocable, generally horizontal movement slightly angular to the reciprocable, generally horizontal movement of the set transport 42 and the copy set clamp 54 which is part of the set transport.

As shown in FIG. 3, the support member 80 has a relatively long dimension, and is adapted to travel approximately at least slightly more than the width of the copy set being supported thereby. A tip 80*a* is secured to the projecting end thereof and is tapered to a point in order to insure that in the event the projecting end of the support rod will always slide below the edge of the copy set being clamped and transported by the set transport 42.

The opposite end of the support member 80 is formed with a downturned element 81 adjustably secured to a endless reversible drive cable 82. The cable is guided around a pulley 84 rotatably secured to a guide bracket 83 mounted on the forward end of the stapler device 44, around an upper idler pulley 85, around a capstan pulley 86 whereon several turns of the cable is arranged and around a lower idler pulley 87. The capstan pulley 86 is secured to a uni-directional, rotational clutch member 88 of an electromagnetic clutch 89 mounted on the shaft 72. As previously stated, the shaft 72 is continuously driven by way of the gear 68. Energization of the clutch 89 effects a drive connection between the shaft 72 and the rotation of the capstan pulley 86 in the direction indicated by the arrow 90. This rotation of the capstan pulley 86 produces motion of the cable 82 in the direction indicated by the arrow 91 and serves to drive the support rod 80 inwardly or to the right, as viewed in FIG. 3.

Energization of the clutch 89 to effect rotation of the capstan pulley 86 also produces rotation of a spring wind-up drum 92 secured to the rotatable member 88 of the clutch. The drum 92 is encircled by a coil spring 94 which has one end 95 secured to the frame for the stapler device 44 and its other end secured to the drum 92. The drum 92 is axially secured to the clutch member 88 which in turn is secured to the capstan pulley 86 so that when the clutch 89 is energized to provide drive connection from the shaft 72, the capstan pulley 86 is rotated to effect retraction of the copy sheet support member 80. This energization of the clutch 89 also produces rotation of the drum 92 in the direction of the arrow 90 and serves to wind up the spring 94 for a purpose to be described hereinafter.

Also drivingly secured to the shaft 72 is a gear 96 in mesh with a gear 97 rotatably mounted on the frame for the drive 44. The gear 97, in turn, is in driving mesh with a larger gear 98 which forms part of a triggering mechanism 100 for releasing the energy stored by the wind-up of the spring 94 in the drive system 75 for effecting the very high speed movement of the support rod 80 from the position shown in FIG. 3 to the position shown in FIG. 2 into a copy set support position along with movement of the set transport 42.

The triggering mechanism 100 includes a circular cam member 101 secured to the gear 98 and mounted for rotation therewith on a shaft 102 mounted on the frame of the device 44. The cam member 101 is formed with a notch 103 on the periphery thereof which is cooperable with a projection 104 formed on one end of a control lever 105 pivotally mounted on a pivot 106 to the frame of the device 44. To the other end of the control lever 105, a solenoid SOL-3 has its plunger 107 connected by a suitable pin 108. Upon energization of the solenoid SOL-3, at the programmed timed interval, the plunger 107 pulls in to effect very quick rotation of the lever 105 to release the projection 104 out of the notch 103 thereby releasing the cam member 101 for rotation along with the rotation of the gear 98 under action of the wound up spring 94.

In operation of the drive system 75 and the triggering mechanism 100, with the shaft 72 being continuously driven by the motor M-1, energization of the clutch 89 connects the system 75 and the mechanism 100 thereto. Drive then is thereby imposed upon the spring drum 92 to affect winding up of the spring 94 which produces a counter rotative force upon the drum 92. Drive is also imparted to the capstan pulley 86 which rotates to drive the cable 83 in the direction of the arrow 91 and to retract the support rod 80 rearwardly. Along with this rotation of the clutch drum 88 is the rotation of the gear 98 by way of the gears 96 and 97 with the consequent rotation of the cam member 101. During these combined drives, when the support member 80 reaches its most rearwarded position, the clutch 88 is deenergized as the cam projection 104 is forced into the cam notch 103 by means of a coil spring 110 encircling the plunger 107 for the solenoid SOL-3. This spring produces rotation of the lever 105 normally in a direction to cause slight sliding contact of the projection 104 on the peripheral cam surface of the cam 101 until the projection 104 reaches the notch 103 whereupon it quickly descends therein.

With the clutch 89 deenergized, the support member 80 in its retracted rearward position, the spring 94 wound up, and the cam projection 101 in the cam match 103, the drive system 75 for the support member 80 and the triggering mechanism 100 is in condition for another cycle of operation of the set transport 42. Upon actuation of the set transport from its fully retracted position, as shown in FIG. 1, to its fully extended position as shown in FIG. 2 whereat the clamp 54 would be disposed to clamp the adjacent side edge of a copy set in one of the bins 30 as shown in FIG. 2, the solenoid SOL-3 is energized by the machine programmer in timed sequence to the initiation of movement of the set transport from its retracted position preparatory for unloading a copy set from one of the bins 30.

In this condition and position of the parts considered in the foregoing paragraph, energization of the solenoid SOL-3 rotates the lever 105 to effect very quick withdrawal of the projection 104 out of the notch 103. This action results in the very quick release of the capstan pulley 86 under action of the wind-up spring 94. Release of the pulley 86 results in the movement of the cable 82 in the direction of the arrow 112 thereby causing the support member 80 to extend to the position shown in FIG. 2 at a high rate of speed. The support member 80 arrives at its support position as the set transport arrives at its copy set gripping position, and remains there as the set transport commences its return or retracted position with the gripped copy set. The support member 80 remains extended with the copy set resting thereon as the set transport returns to its respective position as shown in FIG. 1.

At the instant that the edge of the copy set-to-be-stapled has been clampled in the stapler devices 44 preparatory to being stapled, and stapling is being effected by the devices 44, the clutch 89 is energized to cause the drive connection between the drive shaft 72 and the capstan pulley 86, which drive quickly rotates the capstan pulley, to draw the cable in the direction of the arrow 91 thereby quickly withdrawing the support member 80 from under the copy set then being stapled. Sudden retraction of the support member 80 for each of the stapler devices 44 permits gravity to allow the just stapled copy set to fall upon the previously stapled copy sets on the elevator 46.

When the clutch 89 is energized as described in the foregoing paragraph, the drive by the shaft 72 also produces rotation of the gears 98 and 98 to produce rotation of the rotary cam 101 and the winding of the spring 94 preparatory to another cycle of extension of the support member 80 to the bin array 28 as the set transport 42 is driven to the array to grip another copy set and to transport the same for a stapling operation. When the notch 103 on the cam 101 reaches the position shown in FIG. 4, the clutch 89 is deenergized as the projection 104 is forced into the notch 103 and thereby conditioning the triggering mechanism 100 for another cycle of operation.

From the foregoing, it will be appreciated that the present invention solves the problem of supporting copy sets as the same are transported from one or more compiling stations such as one or more sorter bins and directed to one or more stitching or stapling devices. Specifically, the invention is directed among other attributes, to provide a support member for each two or more stitching or stapling devices, which members cooperate with the movement of a set transport between its copy set gripping position to its copy set stapling position. The drive operation applied to the support member(s) is such that the support provided thereby is in precise timed relation to actuation of a set transport arranged to effect movement of a completed, precollated compilation of a copy set from a compiling station to a stitching/stapling station.

While the invention has been described with reference to the structure disclosed, it is not confined to the details set forth, but is intended to cover such modifications or changes as may come within the scope of the following claims.

We claim:

1. In a reproduction system having a document handling apparatus adapted to transport individual document sheets from a stack to an exposure station and effecting an exposure of each of the document sheets before returning the same to the stack, and a processor for reproducing copy sheets of the exposed sheets, the combination of:

a finishing apparatus adapted to receive collated sets of copy sheets of a set of document sheets and to bind the same, said apparatus including a binding device having a binding position whereat binding of a set of copy sheets is effected during a stapling operation, said finishing apparatus including at least one compiling station whereat collated copy sheets are collected and set transport means for moving a completed copy set from said compiling station to said binding device for stapling thereby, a movable support member associated with said set transport means and being adapted to support a copy set while said transport means is moving a copy set to said binding device as the copy set is transported to said binding position by said set transport means, means for moving said member out of its supporting relationship with a copy set during the binding operation to effect lowering of the same by gravity into a set collecting station.

2. The reproduction system of claim 1 wherein said binding device is a stapler.

3. The reproduction system of claim 2 wherein said stapler includes a clamping position whereat a staple is driven through a set of copy sheets during a stapling operation.

4. In a reproduction system having a document handling apparatus adapted to transport individual document sheets from a stack to an exposure station and effecting an exposure of each of the document sheets before returning the same to the stack, and a processor for reproducing copy sheets of the exposed sheets, the combination of:

a finishing apparatus adapted to receive collated sets of copy sheets of a set of document sheets and to bind the same, said apparatus including at least one stapling device having a clamping position whereat a staple is driven through a set of copy sheets during a stapling operation, said finishing apparatus including at least one compiling station whereat collated copy sheets are collected and having a set transport movable toward said compiling station in one direction of movement thereof, said set transport being adapted to grasp a completed copy set while at said compiling station and to transport the copy set to said clamping position in another direction of movement thereof, a movable member associated with set transport and being adapted to be moved toward said compiling station as said transport is moved in said one direction, said member being adapted to support a copy set as the copy set is transported to said clamping position by said set transport, means for moving said member out of its supporting relationship with the copy set during the stapling operation to effect lowering of the same by gravity into a set collecting station.

5. In a reproduction system having a document handling apparatus adapted to transport individual document sheets from a supply stack to an exposure station and effecting an exposure of each of the document sheets before returning the same to the supply stack, and a processor for reproducing copy sheets of the exposed document sheets, the combination of:

a finishing apparatus adapted to receive collated sets of copy sheets of a set of document sheets and to bind the same, said apparatus including a binding device having a binding position to which an edge of each copy set is brought for a binding operation, said finishing apparatus including at least one coupling station whereat collated copy sheets are collected, set transport means for moving a completed copy set from said compiling station to said binding device and having a support member reciprocably movable in a generally horizontal plane and upon which a completed copy set is supported during transporting of the copy set from said compiling station to said binding position.

6. The system in claim 5 including an elevator means arranged for receiving bound sets after said support member has been moved out of supporting relation with a copy set.

* * * * *